US010693243B2

(12) United States Patent
Zhang et al.

(10) Patent No.: US 10,693,243 B2
(45) Date of Patent: Jun. 23, 2020

(54) SINGLE BAND DUAL CONCURRENT NETWORK DEVICE

(71) Applicant: Extreme Networks, Inc., San Jose, CA (US)

(72) Inventors: Liangfu Zhang, Hangzhou (CN); George Gang Chen, Fremont, CA (US); Changming Liu, Cupertino, CA (US); Zhenye Cao, Hangzhou (CN)

(73) Assignee: Extreme Networks, Inc., San Jose, CA (US)

( * ) Notice: Subject to any disclaimer, the term of this patent is extended or adjusted under 35 U.S.C. 154(b) by 0 days.

(21) Appl. No.: 16/001,200

(22) Filed: Jun. 6, 2018

(65) Prior Publication Data

US 2018/0287267 A1 Oct. 4, 2018

Related U.S. Application Data

(63) Continuation of application No. 15/622,003, filed on Jun. 13, 2017, now Pat. No. 10,003,134, which is a (Continued)

(51) Int. Cl.
*H01Q 21/28* (2006.01)
*H01Q 21/24* (2006.01)
(Continued)

(52) U.S. Cl.
CPC ..... *H01Q 21/28* (2013.01); *H01Q 1/2291* (2013.01); *H01Q 1/521* (2013.01); *H01Q 21/205* (2013.01); *H01Q 21/24* (2013.01)

(58) Field of Classification Search
CPC ..... H01Q 21/28; H01Q 21/24; H01Q 1/22; H01Q 1/2291; H01Q 13/10
See application file for complete search history.

(56) References Cited

U.S. PATENT DOCUMENTS 2,480,186 A * 8/1949 Gilbert ..... H01Q 1/28 343/727
2,639,382 A * 5/1953 Jarvis ..... H01Q 9/265 343/743
(Continued)

FOREIGN PATENT DOCUMENTS

CN 101453304 6/2009
CN 102217211 10/2011
(Continued)

OTHER PUBLICATIONS

International Application No. PCT/US2015/048396, International Search Report and Written Opinion dated Nov. 27, 2015.
(Continued)

*Primary Examiner* — Hoang V Nguyen
(74) *Attorney, Agent, or Firm* — Sterne, Kessler, Goldstein & Fox P.L.L.C.

(57) ABSTRACT

A network device comprising, a first radio module configured to transmit and receive first radio signals in a first frequency band, a first antenna array configured to transmit and receive the first radio signals for the first radio module in the first frequency band, a second radio module configured to transmit and receive second radio signals in the first frequency band, a second antenna array configured to transmit and receive the second radio signals for the second radio module in the first frequency band, wherein, in operation, the first radio module and the second radio modules function concurrently using the first frequency band while at least 40 dB of antenna isolation is maintained between the first antenna array and the second antenna array.

20 Claims, 9 Drawing Sheets

Related U.S. Application Data continuation of application No. 14/845,006, filed on Sep. 3, 2015, now Pat. No. 9,705,207.

(60) Provisional application No. 62/144,280, filed on Apr. 7, 2015, provisional application No. 62/131,769, filed on Mar. 11, 2015.

(51) Int. Cl.

| | |
|---|---|
| ***H01Q 1/22*** | (2006.01) |
| ***H01Q 21/20*** | (2006.01) |
| ***H01Q 1/52*** | (2006.01) |

(56) References Cited

U.S. PATENT DOCUMENTS

| | | | | |
|---|---|---|---|---|
| 3,348,228 | A | 10/1967 | Melancon L | |
| D363,935 | S | 11/1995 | McGreevy | |
| 5,583,524 | A | 12/1996 | Milroy | |
| 6,967,625 | B1 * | 11/2005 | Honda | H01Q 1/246 343/770 |
| 7,123,207 | B2 | 10/2006 | Yazdandoost | |
| D550,633 | S | 9/2007 | Gupta | |
| D558,189 | S | 12/2007 | Inoue | |
| 7,388,553 | B2 | 6/2008 | Yuanzhu | |
| 7,486,249 | B2 | 2/2009 | Fujita | |
| 7,564,423 | B2 | 7/2009 | Ke | |
| D608,769 | S | 1/2010 | Bufe | |
| D695,279 | S | 12/2013 | Yang | |
| D695,280 | S | 12/2013 | Yang | |
| D695,725 | S | 12/2013 | Taeger | |
| D708,602 | S | 7/2014 | Gosalia | |
| D764,447 | S | 8/2016 | Yang | |
| D766,884 | S | 9/2016 | Zheng | |
| D767,544 | S | 9/2016 | Yang | |
| D782,448 | S | 3/2017 | Gosalia | |
| D784,965 | S | 4/2017 | Chang | |
| D788,082 | S | 5/2017 | Zheng | |
| D788,083 | S | 5/2017 | Zheng | |
| D795,228 | S | 8/2017 | He | |
| D795,847 | S | 8/2017 | He | |
| D797,708 | S | 9/2017 | Yang | |
| D801,956 | S | 11/2017 | He | |
| D803,200 | S | 11/2017 | Manivannan | |
| 2002/0173337 | A1 | 11/2002 | Hajimiri | |
| 2003/0193923 | A1 | 10/2003 | Abdelgany | |
| 2003/0206076 | A1 | 11/2003 | Hashemi | |
| 2004/0183726 | A1 | 9/2004 | Theobold | |
| 2005/0062649 | A1 | 3/2005 | Chiang | |
| 2005/0243007 | A1 | 11/2005 | Ke | |
| 2006/0281488 | A1 | 12/2006 | Chang | |
| 2007/0069968 | A1 * | 3/2007 | Moller | H01Q 9/285 343/795 |
| 2007/0097012 | A1 | 5/2007 | Sanelli | |
| 2007/0241986 | A1 | 10/2007 | Lee | |
| 2008/0205509 | A1 | 8/2008 | Le Naour | |
| 2008/0225758 | A1 | 9/2008 | Proctor | |
| 2009/0289867 | A1 | 11/2009 | Chen | |
| 2011/0149164 | A1 | 6/2011 | Goldberg et al. | |
| 2011/0241953 | A1 | 10/2011 | Su | |
| 2012/0164948 | A1 | 6/2012 | Narasimha | |
| 2012/0250666 | A1 | 10/2012 | Bhukania | |
| 2012/0314626 | A1 | 12/2012 | Alapuranen | |
| 2013/0134471 | A1 | 5/2013 | Lee | |
| 2013/0181878 | A1 | 7/2013 | Petros | |
| 2013/0300502 | A1 | 11/2013 | Li | |
| 2013/0315141 | A1 | 11/2013 | Homchaudhuri | |
| 2014/0062812 | A1 | 3/2014 | Smith | |
| 2014/0119245 | A1 | 5/2014 | Desjardins | |
| 2014/0313093 | A1 * | 10/2014 | Smith | H01Q 21/24 343/795 |
| 2015/0036656 | A1 | 2/2015 | McCarthy | |

FOREIGN PATENT DOCUMENTS

| | | |
|---|---|---|
| CN | 202997053 | 6/2013 |
| CN | 103268980 | 8/2013 |
| CN | 104052529 | 9/2014 |
| WO | 2007076105 | 7/2007 |

OTHER PUBLICATIONS

International Application No. PCT/US2016/022206, International Search Report and Written Opinion dated Jun. 3, 2016.

Xirrus, Inc., "Solutions Brief: Migrating to 802.11ac Wireless LANs," white paper, Mar. 10, 2014.

European Patent Application No. 15884897.8, Search Report dated Sep. 10, 2018.

European Patent Application No. 16762678.7, Search Report dated Sep. 10, 2018.

Office Action and Search Report for Chinese Patent Application No. 201580079831.5, Chinese Patent Office, Beijing, China, dated Jan. 20, 2020.

* cited by examiner

SINGLE BAND DUAL CONCURRENT NETWORK DEVICE

CROSS-REFERENCE TO RELATED APPLICATIONS

This application is a continuation of U.S. patent application Ser. No. 15/622,003, filed Jun. 13, 2017, which is a continuation of U.S. patent application Ser. No. 14/845,006, filed Sep. 3, 2015, now U.S. Pat. No. 9,705,207, which claims priority to U.S. Provisional Patent Application Nos. 62/131,769, filed Mar. 11, 2015, entitled "Antenna Isolation and Radio Design," and 62/144,280, filed Apr. 7, 2015, entitled, "Antenna Design," all of which are incorporated herein by reference.

BACKGROUND

An area of ongoing research and development is network devices and antenna designs. In particular, access points are being developed with two radios that can operate in the same frequency band. One issue is that interference caused by two radios operating in the same frequency band concurrently makes concurrent operation difficult. One solution is to make access points larger in order to physically isolate the antennas of the two radios. This is impractical as access points typically are of a compact size. Another solution is to dynamically switch operation of the two radios. This is problematic in that the access point does not actually have two radios that are actually operating in the same frequency band simultaneously.

There therefore exists a need for network devices of a practical size with radios that can operate in the same frequency band concurrently.

The foregoing examples of the related art and limitations related therewith are intended to be illustrative and not exclusive. Other limitations of the relevant art will become apparent to those of skill in the art upon reading the specification and studying of the drawings.

SUMMARY

The following implementations and aspects thereof are described and illustrated in conjunction with systems, tools, and methods that are meant to be exemplary and illustrative, not necessarily limiting in scope. In various implementations one or more of the above-described problems have been addressed, while other implementations are directed to other improvements.

Various implementations include network devices and antenna designs for network devices with radios that can operate in the same frequency band concurrently.

In various implementations, a first radio module is configured to transmit and receive first radio signals in a first frequency band, a first antenna array comprised of a first plurality of polarized antennas is configured to transmit and receive the first radio signals for the first radio module in the first frequency band, a second radio module is configured to transmit and receive second radio signals in the first frequency band, a second antenna array comprised of a second plurality of polarized antennas is configured to transmit and receive the second radio signals for the second radio module in the first frequency band, wherein, in operation, the first radio module and the second radio modules function concurrently using the first frequency band while at least 40 dB of antenna isolation is maintained between the first antenna array and the second antenna array.

These and other advantages will become apparent to those skilled in the relevant art upon a reading of the following descriptions and a study of the several examples of the drawings.

DETAILED DESCRIPTION

Figure 1:
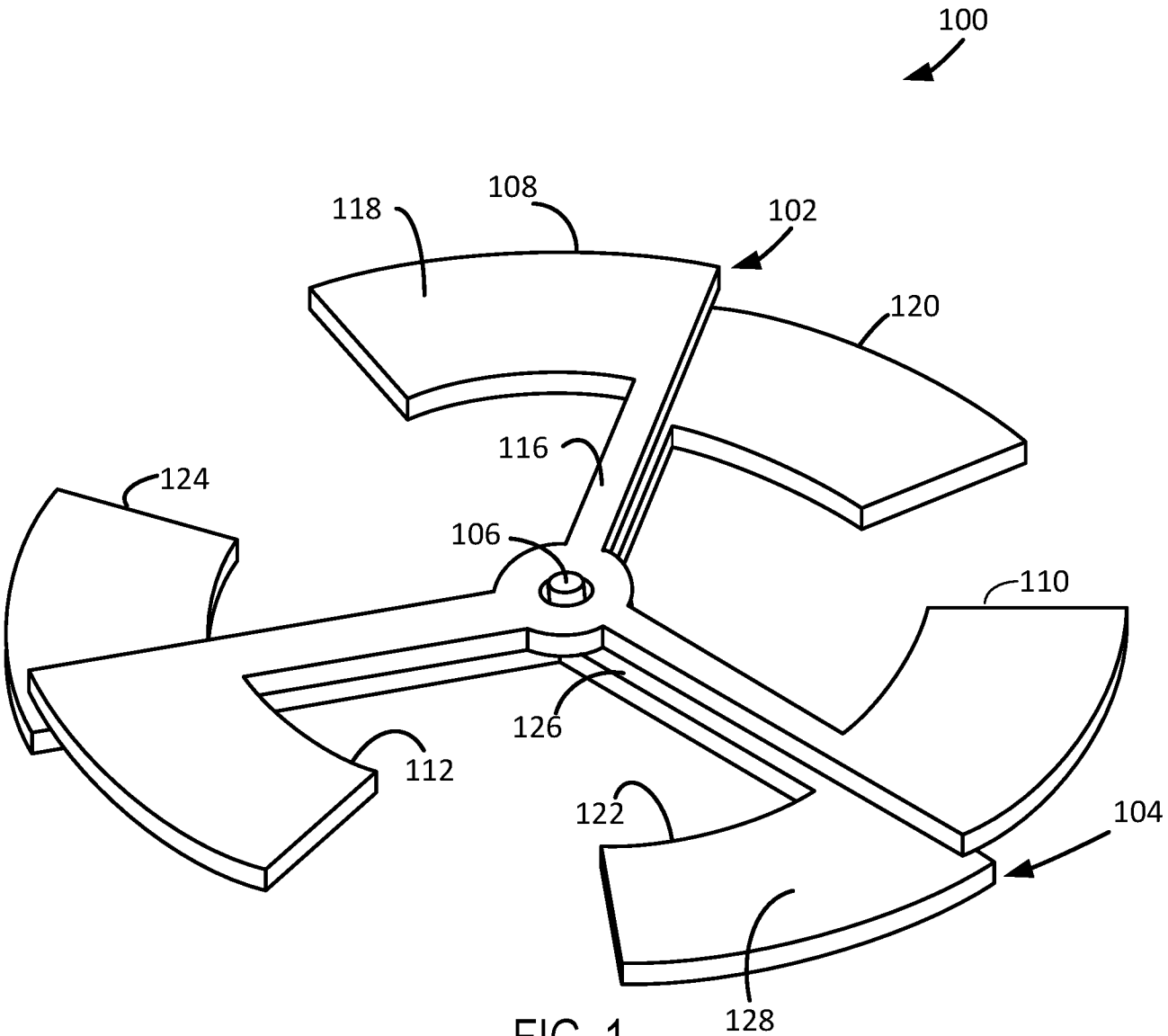
FIG. 1 depicts a perspective view of an example of a polarized antenna.

FIG. 1 depicts a perspective view 100 of an example of a polarized antenna. The polarized antenna can be implemented as part of a network device for transmitting and receiving data according to applicable protocols for forming part of a wireless network, including Wi-Fi, such as the IEEE 802.11 standards, which are hereby incorporated by reference. Depending upon implementation-specific or other considerations, the polarized antenna can be positioned to be horizontally polarized with respect to a network device.

In a specific implementation, the polarized antenna is wirelessly coupled through a Wi-Fi connection to an end user device, which acts as or includes a station. A station, as used in this paper, can be referred to as a device with a media access control (MAC) address and a physical layer (PHY) interface to a wireless medium that complies with the IEEE 802.11 standard. Thus, for example, the end user devices can be referred to as stations, if applicable. IEEE 802.11a-1999, IEEE 802.11b-1999, IEEE 802.11g-2003, IEEE 802.11-2007, and IEEE 802.11n TGn Draft 8.0 (2009) are incorporated by reference. As used in this paper, a system that is 802.11 standards-compatible or 802.11 standards-compliant complies with at least some of one or more of the incorporated documents' requirements and/or recommendations, or requirements and/or recommendations from earlier drafts of the documents, and includes Wi-Fi systems. Wi-Fi is a non-technical description that is generally correlated with the IEEE 802.11 standards, as well as Wi-Fi Protected Access (WPA) and WPA2 security standards, and the Extensible Authentication Protocol (EAP) standard. In alternative embodiments, a station may comply with a different standard than Wi-Fi or IEEE 802.11, may be referred to as something other than a "station," and may have different interfaces to a wireless or other medium.

In a specific implementation, the polarized antenna is part of a network device which is compliant with IEEE 802.3. IEEE 802.3 is a working group and a collection of IEEE standards produced by the working group defining the physical layer and data link layer's MAC of wired Ethernet. This is generally a local area network technology with some wide area network applications. Physical connections are typically made between nodes and/or infrastructure devices (hubs, switches, routers) by various types of copper or fiber cable. IEEE 802.3 is a technology that supports the IEEE 802.1 network architecture. As is well-known in the relevant art, IEEE 802.11 is a working group and collection of standards for implementing wireless local area network (WLAN) computer communication in the 2.4, 3.6 and 5 GHz frequency bands. The base version of the standard IEEE 802.11-2007 has had subsequent amendments. These standards provide the basis for wireless network products using the Wi-Fi brand. IEEE 802.1 and 802.3 are incorporated by reference.

In a specific implementation, the polarized antenna is coupled to a radio. Depending upon implementation-specific or other considerations, a radio can be a 2.4 GHz to 5 GHz dual band radio or a 5 GHz only radio. Further depending upon implementation-specific or other considerations, the polarized antenna can be included as part of a network device that includes radios operating in the same frequency band concurrently. For example, the polarized antenna can be included as part of a network device including a first radio operating the 5 GHz band concurrently with a second radio operating in the 5 GHz band. In another example, the polarized antenna can be included as part of a network device including a 2.4 GHz to 5 GHz dual band radio operating in the 5 GHz band concurrently with a 5 GHz only radio operating in the 5 GHz band.

The polarized antenna includes a first conductive plate 102 in a first antenna plane and a second conductive plate 104 in a second antenna plane. The first conductive plate 102 and the second conductive plate 104 are mounted together about a central joint 106. The joint can be fixed such that the first antenna plane and the second antenna plane are parallel to each other or flexible such that the first antenna plane and the second antenna plane intersect each other at a line of intersection. In various implementations, the first conductive plate 102, the second conductive plate 104, and the central joint are comprised of, at least in part, an electrically conductive material.

The first conductive plate 102 includes a first antenna blade 108, a second antenna blade 110, and a third antenna blade 112. Each of the first antenna blade 108, the second antenna blade 110, and the third antenna blade 112, include a corresponding arm 116 and wing 118. Corresponding arms of the first antenna blade 108, the second antenna blade 110, and the third antenna blade 112 are angularly spaced from each other around the central joint 106. For example, the arms can be spaced 120° apart from each other about the central joint 106. Each corresponding wing of the first antenna blade 108, the second antenna blade 110, and the third antenna blade 112 extend out from each corresponding arm along a counter clockwise direction. As a result, the first conductive plate 102 can exhibit rotational symmetry about the central joint 106.

The second conductive plate 104 includes a first antenna blade 120, a second antenna blade 122, and a third antenna blade 124. Each of the first antenna blade 120, the second antenna blade 122, and the third antenna blade 124 of the second conductive plate include a corresponding arm 126 and wing 128. Corresponding arms of the first antenna blade 120, the second antenna blade 122, and the third antenna blade 124 of the second conductive plate are angularly spaced from each other around the central joint 106. For example, the arms can be spaced 120° apart from each other about the central joint 106. Each corresponding wing of the first antenna blade 120, the second antenna blade 122, and the third antenna blade 124 of the second conductive plate 104 extend out from each corresponding arm along a clockwise direction. As a result, the second conductive plate 104 can exhibit rotational symmetry about the central joint 106.

In a specific implementation, corresponding arms of the first blades 108 and 120 of the first and second conductive plates 102 and 104, corresponding arms of the second blades 110 and 122 of the first and second conductive plates 102 and 104, and/or corresponding arms of the third blades 112 and 124 of the first and second conductive plates 102 and 104 overlay each other such that they exhibit mirror symmetry about an axis along the center of the corresponding arms of the blades when viewed from a top view or a bottom view of the antenna. For example, the arms and wings of the third blade 112 of the first second conductive plate 102 and the arms and wings of the third blade 124 of the second conductive plate 104 can be of the same size and extend along apposing clockwise and counter clockwise directions such that the arms and wings exhibit mirror symmetry about an axis along the center of the arms when viewed from a top view or a bottom view of the antenna. In a specific implementation, arms of corresponding blades are 12 mm long with each wing being 4 mm by 8 mm.

Figure 2:
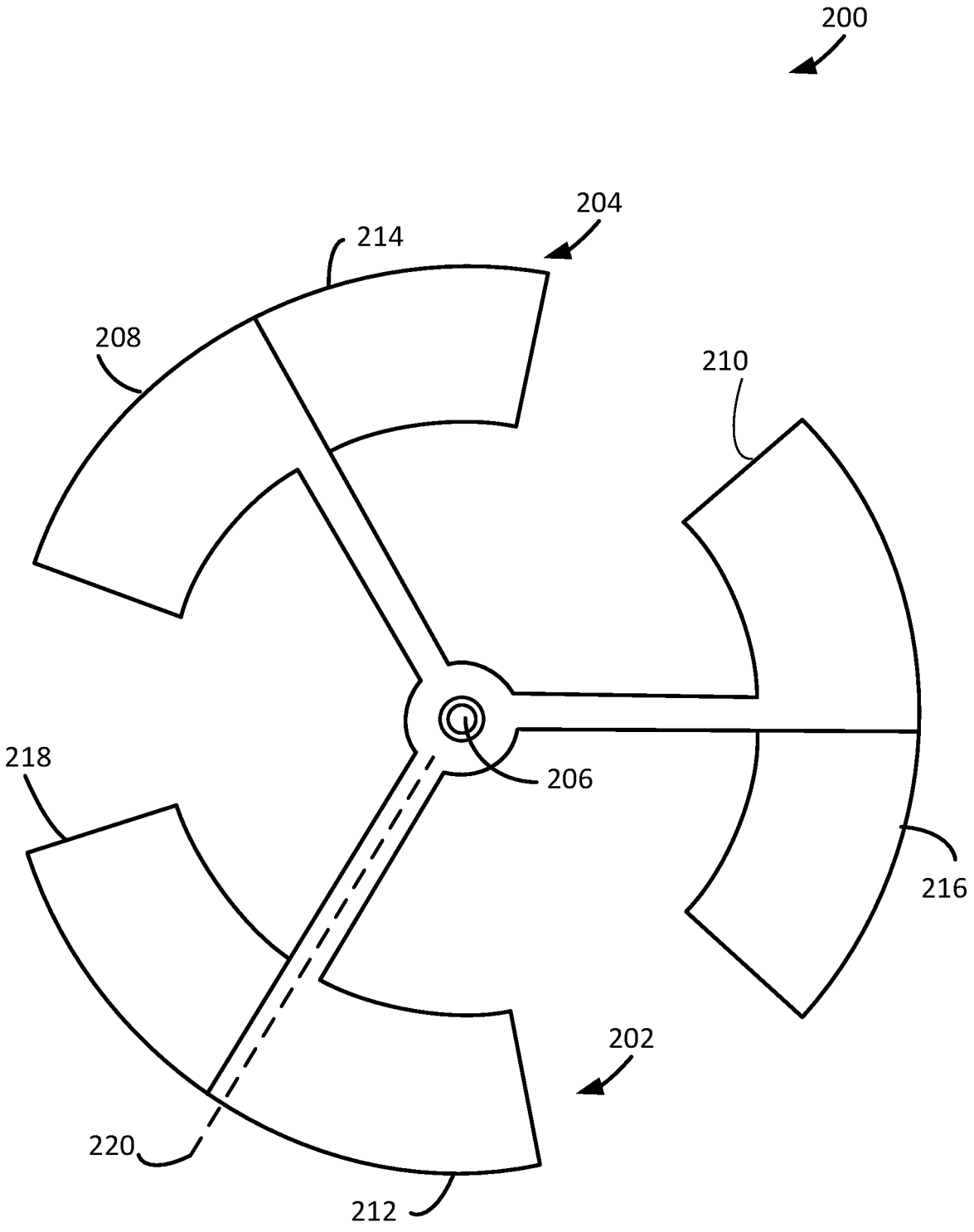
FIG. 2 depicts a top view of an example of a polarized antenna.

FIG. 2 depicts a top view 200 of an example of a polarized antenna. The polarized antenna includes a first conductive plate 202 and a second conductive plate 204 coupled together at a joint 206. The first conductive plate 202 includes a first blade 208, a second blade 210, and a third blade 212. The first blade 208, the second blade 210, and the third blade 212 of the first conductive plate 202 include wings that extend out from arms in a counter clockwise direction. The second conductive plate 204 includes a first blade 214, a second blade 216, and a third blade 218. The first blade 214, the second blade 216, and the third blade 218 of the second conductive plate 204 include wings that extend out from arms in a clockwise direction. The first conductive plate 202 and the second conductive plate 204 are positioned such that corresponding arms of the first blade 208 of the first conductive plate 202 and the first blade 214 of the second conductive plate 204, arms of the second blade 210 of the first conductive plate 202 and the second blade 216 of the second conductive plate 204, arms of the third blade 212 of the first conductive plate 202 and the third blade 218 of the second conductive plate 204, overlap. As a result, corresponding first blades, second blades, and third blades exhibit mirror symmetry about an axis, e.g. 220, along a center of the arms of the corresponding blades.

Figure 3:
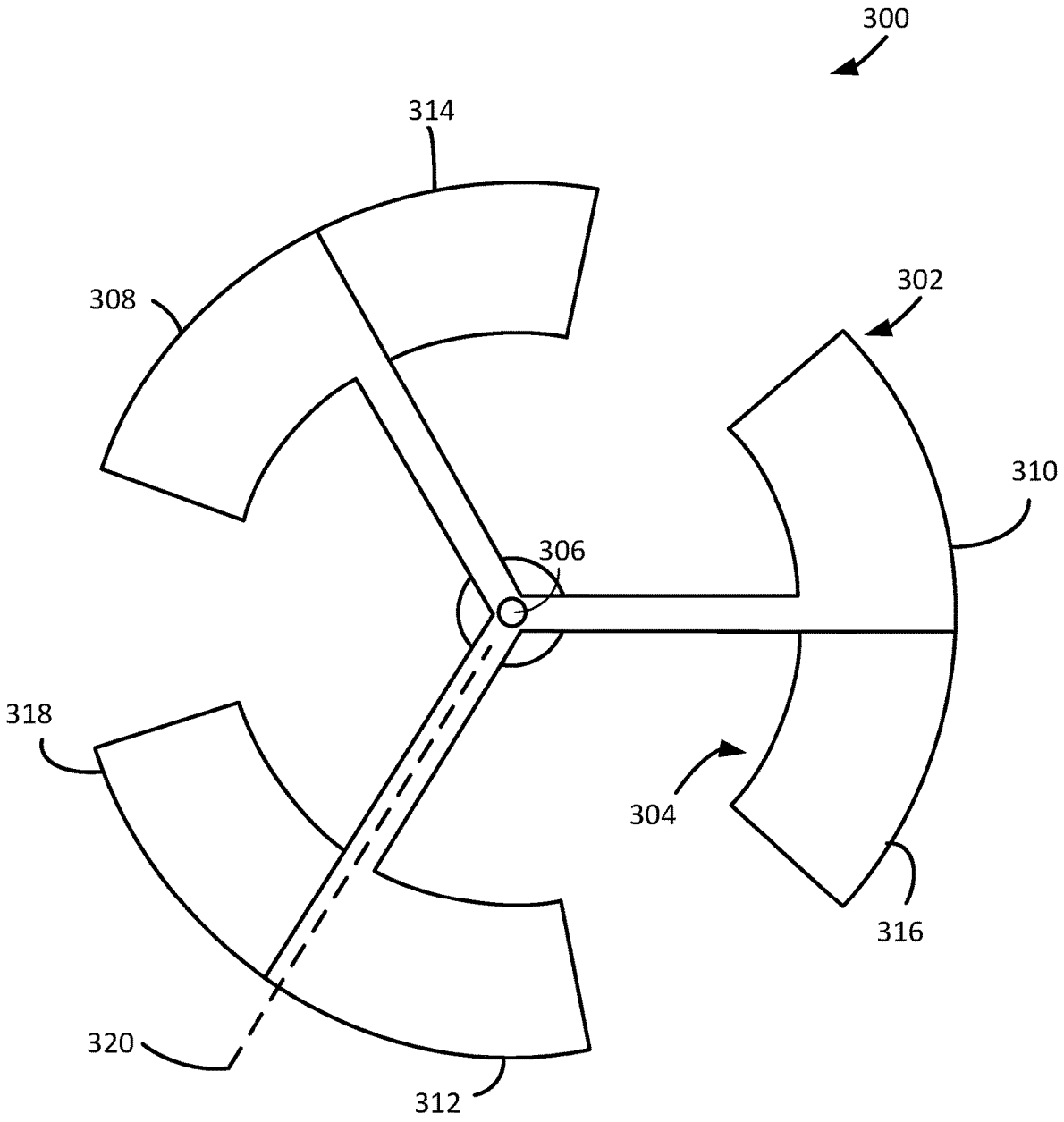
FIG. 3 depicts a bottom view of an example of a polarized antenna.

FIG. 3 depicts a bottom view 300 of an example of a polarized antenna. The polarized antenna includes a second conductive plate 302 and a first conductive plate 304 coupled together at a joint 306. The second conductive plate 302 includes a first blade 308, a second blade 310, and a third blade 312. The first blade 308, the second blade 310, and the third blade 312 of the second conductive plate 302 include wings that extend out from arms in a counter clockwise direction. The first conductive plate 304 includes a first blade 314, a second blade 316, and a third blade 318. The first blade 314, the second blade 316, and the third blade 318 of the first conductive plate 304 include wings that extend out from arms in a clockwise direction. The second conductive plate 302 and the first conductive plate 304 are positioned such that corresponding arms of the first blade 308 of the second conductive plate 302 and the first blade 314 of the first conductive plate 304, arms of the second blade 310 of the second conductive plate 302 and the second blade 316 of the first conductive plate 304, arms of the third blade 312 of the second conductive plate 302 and the third blade 318 of the first conductive plate 304, overlap. As a result, corresponding first blades, second blades, and third blades exhibit mirror symmetry about an axis, e.g. 320, along a center of the arms of the corresponding blades.

Figure 4:
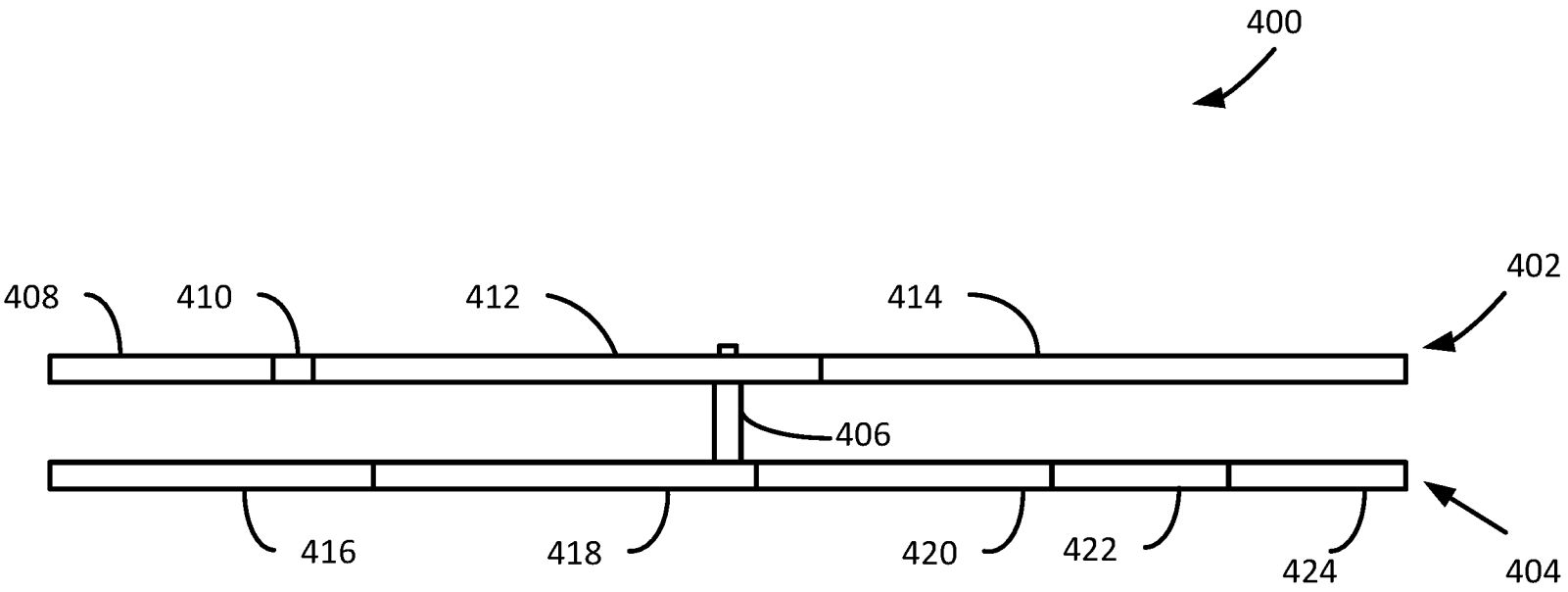
FIG. 4 depicts a front view of an example of a polarized antenna.

FIG. 4 depicts a front view 400 of an example of a polarized antenna. The polarized antenna includes a first conductive plate 402 and a second conductive plate 404 coupled together at a joint 406. The first conductive plate 402 includes a flat portion 408 of a first wing opposite a first arm to which the first wing is attached, a rounded inner portion 410 of the first wing, a rounded outer portion 412 of a second wing attached to a second arm (not visible), and a third arm 414. The second conductive plate 404 includes a rounded outer portion 416 of a fourth wing attached to a fourth arm, the fourth arm 418, a fifth arm 420, a flat portion 422 of a fifth wing opposite the fifth arm to which the fifth wing is attached, and a rounded outer portion 424 of the fifth wing.

Figure 5:
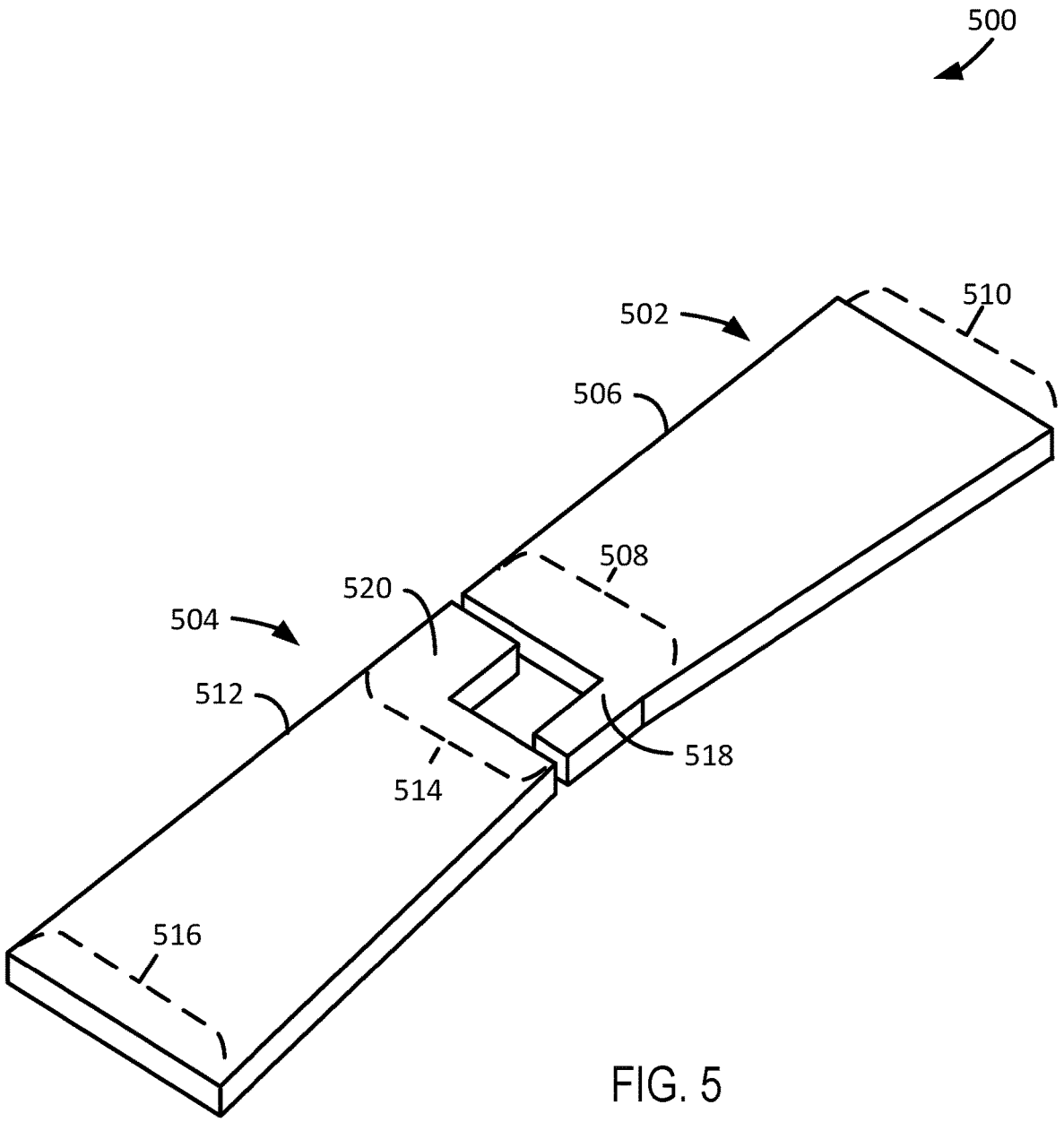
FIG. 5 depicts a perspective view of another example of a polarized antenna.

FIG. 5 depicts a perspective view 500 of another example of a polarized antenna. The polarized antenna can be implemented as part of a network device for transmitting and receiving data according to applicable protocols for forming part of a wireless network, including Wi-Fi, such as the IEEE 802.11 standards. Depending upon implementation-specific or other considerations, the polarized antenna can be positioned to be vertically polarized with respect to a network device.

In a specific implementation, the polarized antenna is wirelessly coupled through a Wi-Fi connection to an end user device, which acts as or includes a station. A station, as used in this paper, can be referred to as a device with a media access control (MAC) address and a physical layer (PHY) interface to a wireless medium that complies with the IEEE 802.11 standard. Thus, for example, the end user devices can be referred to as stations, if applicable.

In a specific implementation, the polarized antenna is part of a network device which is compliant with IEEE 802.3. IEEE 802.3 is a working group and a collection of IEEE standards produced by the working group defining the physical layer and data link layer's MAC of wired Ethernet. This is generally a local area network technology with some wide area network applications. Physical connections are typically made between nodes and/or infrastructure devices (hubs, switches, routers) by various types of copper or fiber cable. IEEE 802.3 is a technology that supports the IEEE 802.1 network architecture. As is well-known in the relevant art, IEEE 802.11 is a working group and collection of standards for implementing wireless local area network (WLAN) computer communication in the 2.4, 3.6 and 5 GHz frequency bands. The base version of the standard IEEE 802.11-2007 has had subsequent amendments. These standards provide the basis for wireless network products using the Wi-Fi brand.

In a specific implementation, the polarized antenna is coupled to a radio. Depending upon implementation-specific or other considerations, a radio can be a 2.4 GHz to 5 GHz dual band radio or a 5 GHz only radio. Further depending upon implementation-specific or other considerations, the polarized antenna can be included as part of a network device that includes radios operating in the same frequency band concurrently. For example, the polarized antenna can be included as part of a network device including a first radio operating the 5 GHz band concurrently with a second radio operating in the 5 GHz band. In another example, the polarized antenna can be included as part of a network device including a 2.4 GHz to 5 GHz dual band radio operating in the 5 GHz band concurrently with a 5 GHz only radio operating in the 5 GHz band.

The polarized antenna includes a first conductive plate 502 and a second conductive plate 504. In various implementations, the first conductive plate 502 and the second conductive plate 504 are comprised of, at least in part, an electrically conductive material. The first conductive plate 502 linearly increases in width along an edge 506 from a first width 508 to a second width 510. In a specific implementation, the edge 506 has a length of 8 mm, the first width 508 is 4 mm and the second width 510 is 6 mm. The second conductive plate 504 linearly increases in width along an edge 512 from a first width 514 to a second width 516. In a specific implementation, the edge 512 has a length of 8 mm, the first width 514 is 4 mm and the second width 516 is 6 mm.

The first conductive plate 502 includes a protrusion 518. The second conductive plate 504 includes a protrusion 520. The protrusion 518 and the protrusion 520 have sides that face each other to form a channel. In a specific implementation, the protrusion 518 is of a smaller size than the protrusion 520. The protrusions 518 and 520 extend out from the first conductive plate 502 and the second conductive plate 504 to form a channel between the first conductive plate 502 and the second conductive plate 504.

Figure 6:
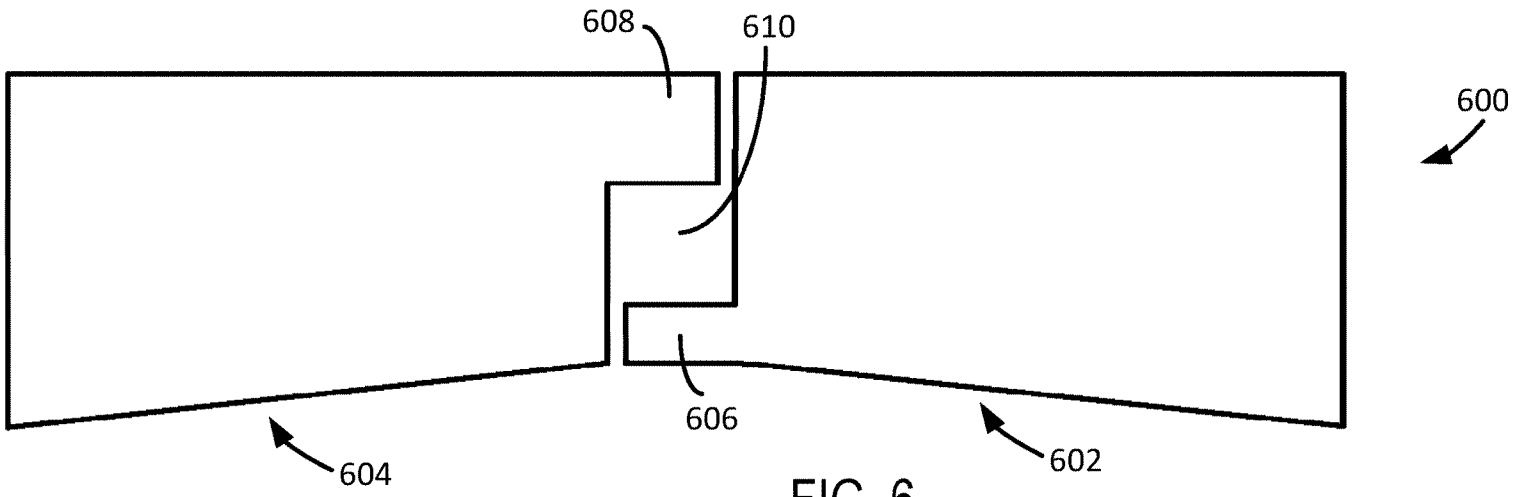
FIG. 6 depicts a top view of another example of a polarized antenna.

FIG. 6 depicts a top view 600 of another example of a polarized antenna. The polarized antenna includes a first conductive plate 602 and a second conductive plate 604. The first conductive plate 602 includes a protrusion 606. The second conductive plate 604 includes a protrusion 608. The protrusions 606 and 608 extend out from the first conductive plate 602 and the second conductive plate 604 to form a channel 610 between the first conductive plate 602 and the second conductive plate 604.

Figure 7:
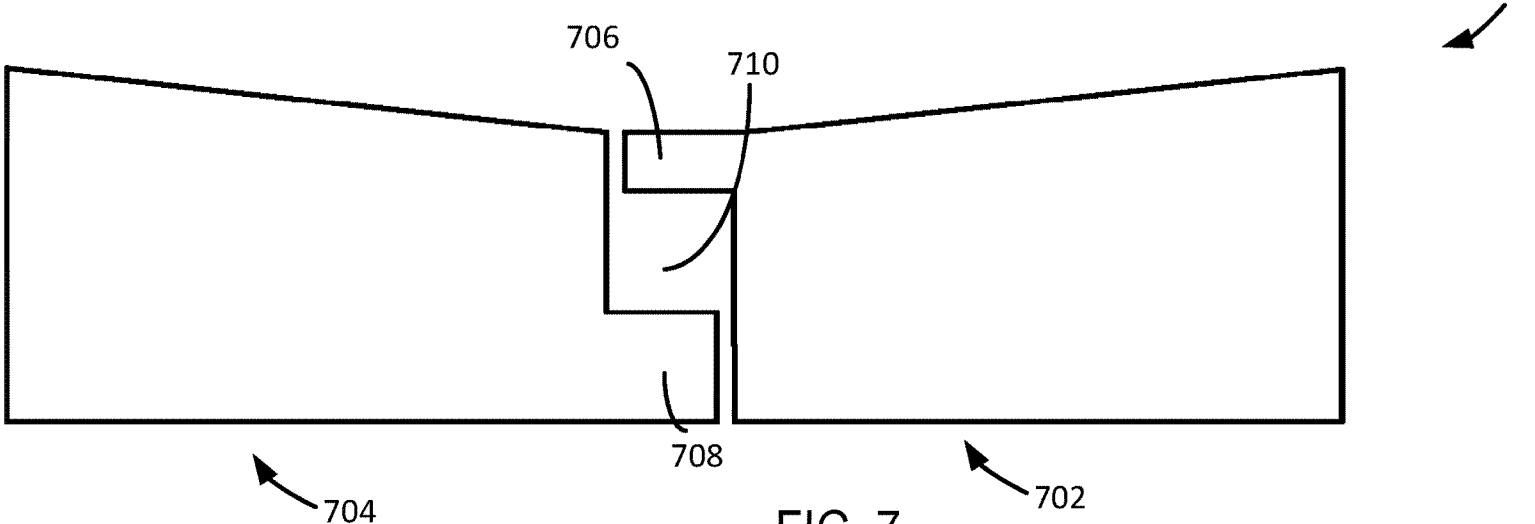
FIG. 7 depicts a bottom view of another example of a polarized antenna.

FIG. 7 depicts a bottom view 700 of another example of a polarized antenna. The polarized antenna includes a first conductive plate 702 and a second conductive plate 704. The first conductive plate 702 includes a protrusion 706. The second conductive plate 704 includes a protrusion 708. The protrusions 706 and 708 extend out from the first conductive plate 702 and the second conductive plate 704 to form a channel 710 between the first conductive plate 702 and the second conductive plate 704.

Figure 8:
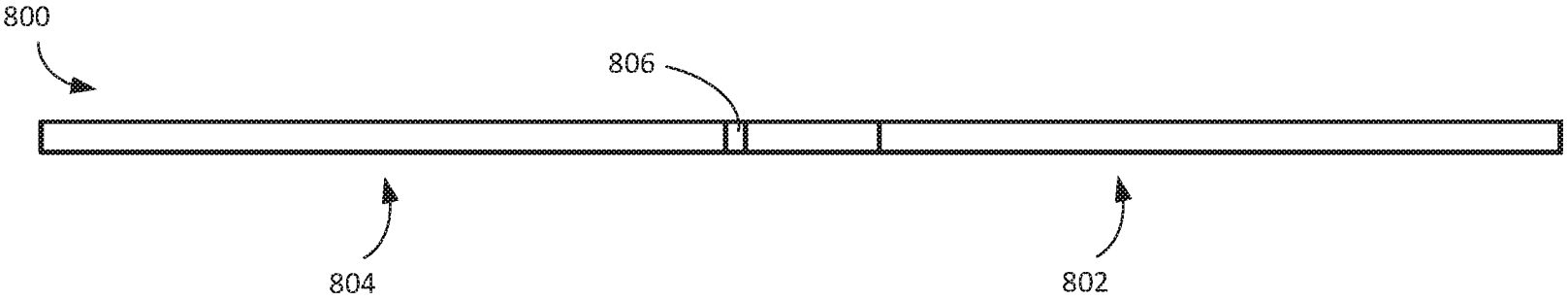
FIG. 8 depicts a front view of another example of a polarized antenna.

FIG. 8 depicts a front view 800 of another example of a polarized antenna. The polarized antenna includes a first conductive plate 802 and a second conductive plate 804. A channel 806 exists between the first conductive plate 802 and the second conductive plate 804.

Figure 9:
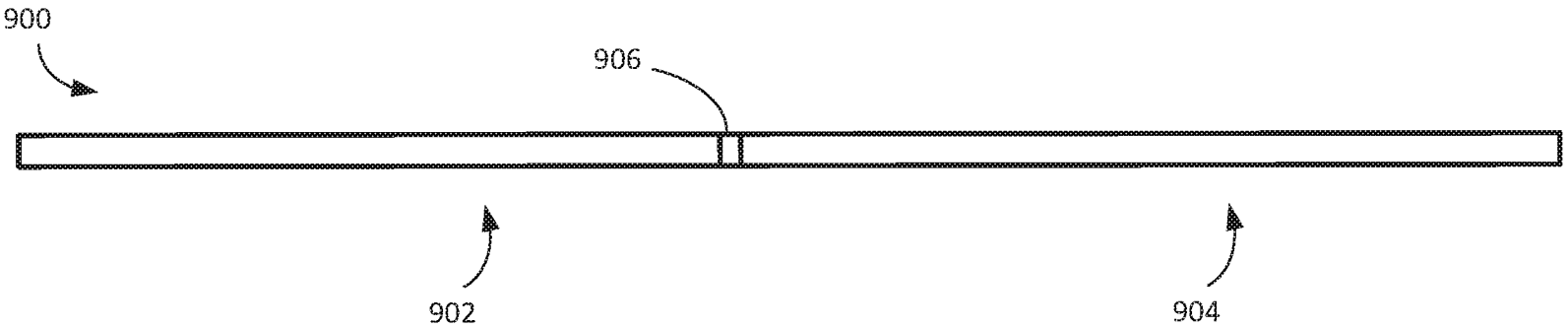
FIG. 9 depicts a back view of another example of a polarized antenna.

FIG. 9 depicts a back view 900 of another example of a polarized antenna. The polarized antenna includes a first conductive plate 902 and a second conductive plate 904. A channel 906 exists between the first conductive plate 902 and the second conductive plate 904.

Figure 10:
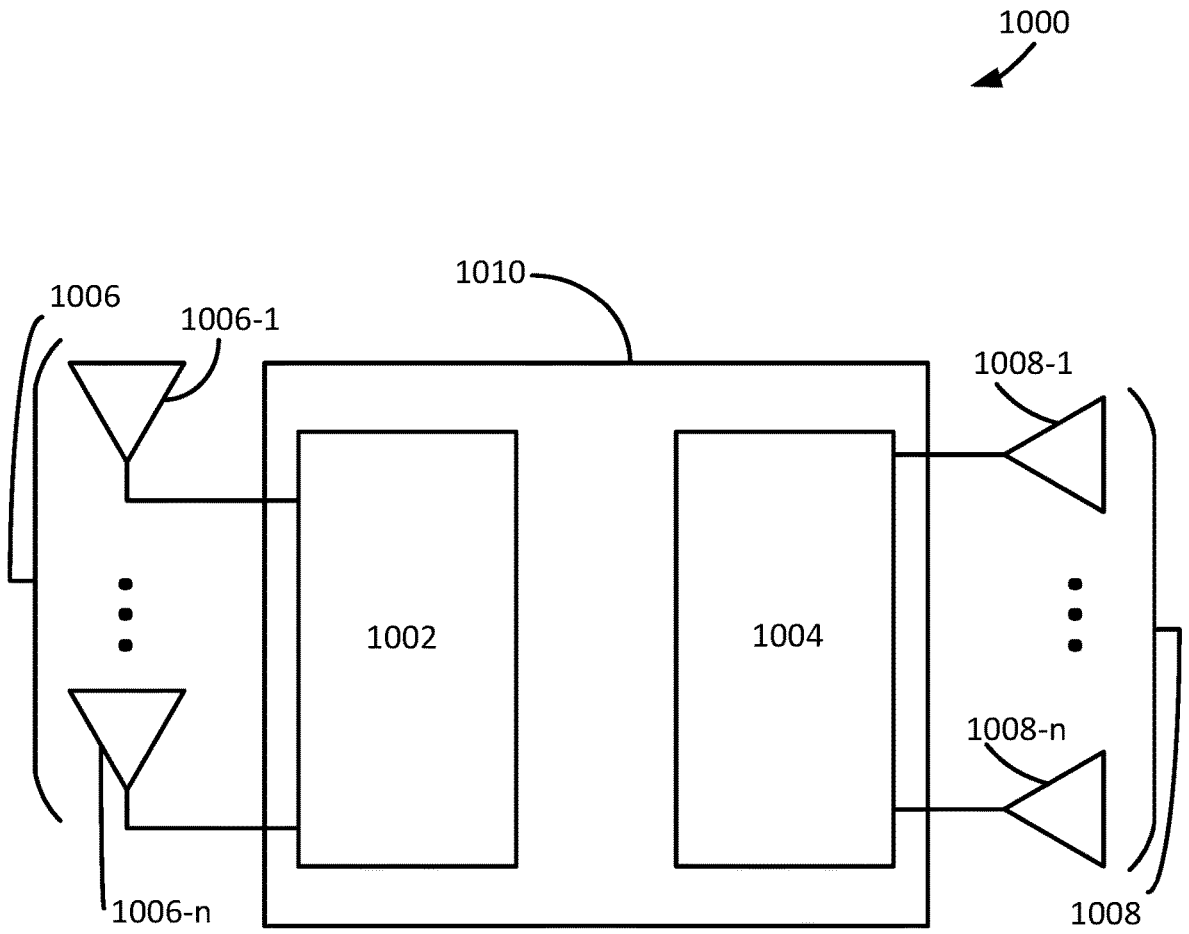
FIG. 10 depicts an example diagram of a single band dual concurrent network device.

FIG. 10 depicts an example diagram 1000 of a single band dual concurrent network device. As used in this paper, a network device is intended to represent a router, a switch, an access point, a gateway (including a wireless gateway), a repeater, or any combination thereof. In functioning as a gateway, the network device can transport data from a backend of a network to a device coupled to the network device. In functioning as an access point, the network device can couple a device coupled to the network device to a network associated with the network device. The network device can function according to applicable protocols for forming part of a wireless network, such as Wi-Fi.

Conventional network devices must be of a suitable size for consumer adoption. Because a typical size of a network device, such as a wireless access point, is small enough to be mounted on a ceiling (typically less than a foot in any horizontal direction and typically no thicker than 2 inches), simultaneous radio operation is considered difficult or impossible. Advantageously, by utilizing polarized antennas, examples of which are discussed above with reference to FIGS. 1-9, a network device can be fashioned that meets the consumer-driven requirements of a relatively small form factor suitable for mounting on ceilings or walls.

As used in this paper, the network device is single band and dual concurrent in that it includes two radio modules capable of operating within the same frequency band simultaneously with non-debilitating mutual interference between signals transmitted by the two radio modules. Depending upon implementation-specific or other considerations, respective antennas utilized by the radios to transmit signals within the same frequency band simultaneously have at least 40 dB or greater of antenna isolation. For example, first one or a plurality of antennas transmitting signals within the 5 GHz frequency band from a first radio module operating concurrently with second one or a plurality of antennas transmitting signals concurrently within the 5 GHz frequency band have 45 dB of antenna isolation with the second one or a plurality of antennas.

The single band dual concurrent network device shown in FIG. 10 includes a first radio module 1002 and a second radio module 1004. Depending upon implementation-specific or other considerations, the first radio module 1002 and the second radio module 1004 can be mounted on a main printed circuit board (hereinafter referred to as "PCB") of the single band dual concurrent network device or formed in separate module housed within an enclosure of the single band dual concurrent network device. For example, the first radio module 1002 can be integrated as part of a first module and the second radio module 1002 can be integrated as part of a second module separate from the first module.

In a specific implementation, either or both the first radio module 1002 and the second radio module 1004 are dual band radios that are capable of dynamically switching operation in different frequency bands. For example, either or both the first radio module 1002 and the second radio module 1004 can be capable of transmitting signals in the 2.4 GHz and the 5 GHz frequency bands. In another example, only one of the first radio module 1002 or the second radio module 1004 is capable of transmitting signals in the 2.4 GHz and the 5 GHz frequency bands, while the other of the first radio module 1002 or the second radio module 1004 is only capable of transmitting signals in the 5 GHz frequency band. In various implementations, the first radio module 1002 and the second radio module 1004 are capable of operating simultaneously within the same frequency band. For example, both the first radio module 1002 and the second radio module 1004 can transmit and receive signals in the 5 GHz frequency band simultaneously.

The single band dual concurrent network device shown in FIG. 10 includes a first antenna array 1006 comprising antennas 1006-1 . . . **1006-*n* and a second antenna array 1008 comprising antennas 1008-1 . . . 1008-*n*. The first antenna array 1006 is associated with the first radio module 1002 and is used to transmit and receive signals for the first radio module 1002 and the second antenna array 1008 is used to transmit and receive signals for the second radio module 1004. Depending upon implementation-specific or other considerations, the first antenna array 1006 and the second antenna array 1008 can include an applicable number of antennas. For example, the first antenna array 1006 and the second antenna array 1008** can each include four corresponding antennas.

In a specific implementation, antennas forming the first antenna array 1006 are of the same polarization and antennas forming the second antenna array 1008 are of the same polarization. For example, antennas forming the first antenna array 1006 can all be either vertically polarized or horizontally polarized with respect to the single band dual concurrent network device. In another example, antennas forming the second antenna array 1008 can all be either vertically polarized or horizontally polarized with respect to the single band dual concurrent network device. Depending upon implementation-specific or other considerations, antennas forming the first antenna array 1006 can be of the same design as the polarized antenna shown in FIGS. 1-4 or the polarized antenna shown in FIGS. 5-9. Further depending upon implementation-specific or other considerations, antennas forming the second antenna array 1008 can be of the same design as the polarized antenna shown in FIGS. 1-4 or the polarized antenna shown in FIGS. 5-9.

In a specific implementation, antennas forming the first antenna array 1006 are orthogonally polarized with respect to the antennas forming the second antenna array 1008. As a result, the first radio module 1002 and the second radio module 1004 utilize corresponding polarized antennas that have a 90° phase offset from each other. For example, the first antenna array 1006 can be formed by vertically polarized antennas that are positioned to have a +45° phase offset with respect to a center of the single band dual concurrent network device, while the second antenna array 1008 can be formed by horizontally polarized antennas that are positioned to have a −45° phase offset with respect to the center of single band dual concurrent network device, thereby leading to a 90° phase offset between the antennas forming the first antenna array 1006 and the antennas forming the second antenna array 1008. While in the previous example, antenna position and phase offset is discussed with respect to a center of the single band dual concurrent network device, positions and phase offsets of antennas forming the first antenna array 1006 and antennas forming the second antenna array 1008 can be with reference to an applicable point, axis, or plane within or in an environment surrounding the single band dual concurrent network device as long as the antennas forming the first antenna array 1006 and the antennas forming the second antenna array 1008 are orthogonally polarized with respect to each other. Due to orthogonal polarization between antennas forming the first antenna array 1006 and antennas forming the second antenna array 1008, at least 40 dB of antenna isolation can be achieved between the antennas forming the first antenna array 1006 and the antennas forming the second antenna array 1008.

In a specific implementation, the first antenna array 1006 and the second antenna array 1008 are mounted about a main PCB of the single band dual concurrent network device. Antennas of the first antenna array 1006 and the second antenna array can be mounted at positions at least 5 mm away from edges of a main PCB. Depending upon implementation-specific or other considerations, the first antenna array 1006 and the second antenna array 1008 are mounted about a main PCB based on a polarization direction of antennas forming the first antenna array 1006 and the second antenna array 1008. For example, if antennas forming the first antenna array 1006 are vertically polarized with respect to a center of the single band dual concurrent network device, then the antennas can be positioned at positions 30 mm out from edges of a main PCB along a plane that extends out from the edges of the main PCB. In another example, if antennas forming the second antenna array 1008 are horizontally polarized with respect to a center of the single band dual concurrent network device, then the antennas can be positioned at positions 5 mm out from edges of a main PCB along a plane that extends out from the edges of the main PCB and 5 mm below or beneath the plane. In mounting antennas of the first antenna array 1006 and the second array at positions away from a main PCB of the single band dual concurrent network device, antenna coupling through the main PCB between the first antenna array 1006 and the second antenna array 1008 is reduced, thereby leading to at least 40 dB of antenna isolation between the antennas forming the first antenna array 1006 and the antennas forming the second antenna array 1008.

In a specific implementation, the first antenna array 1006 and the second antenna array 1008 are mounted onto an antenna plate. Antennas of the first antenna array 1006 and the second antenna array can be mounted to an antenna plate such that the antenna are at least 5 mm away from edges of the antenna plate. Depending upon implementation-specific or other considerations, the first antenna array 1006 and the second antenna array 1008 are mounted to an antenna plate based on a polarization direction of antennas forming the first antenna array 1006 and the second antenna array 1008. For example, if antennas forming the first antenna array 1006 are vertically polarized with respect to a center of the single band dual concurrent network device, then the antennas can be mounted to an antenna plate at positions 30 mm from edges of the antenna plate. In mounting antennas of the first antenna array 1006 and the second array to an antenna plate at positions away from edges of the antenna plate, antenna coupling through the antenna plate between the first antenna array 1006 and the second antenna array 1008 is reduced, thereby leading to at least 40 dB of antenna isolation between the antennas forming the first antenna array 1006 and the antennas forming the second antenna array 1008. Depending upon implementation-specific or other considerations, an antenna plate to which antennas of the first antenna array 1006 and the second antenna array 1008 are mounted can be positioned within the single band dual concurrent network device such that spacing between the antennas of the first antenna array 1006 and the second antenna array 1008 and edges of a main PCB or other applicable common metal structure is at least 5 mm. For example, an antenna plate can be mounted at a position on top of, on bottom of, or on side of a main PCB, such that spacing between antennas of the first antenna array 1006 and the second antenna array 1008 and edges of the main PCB is at least 5 mm.

The single band dual concurrent network device includes a housing 1010. While antennas of the first antenna array 1006 and antennas of the second antenna array 1008 are shown to extend out of the housing 1010 in FIG. 10, this is shown for conceptual purposes and it is understood that the antennas can be contained within the housing 1010 or integrated as part of the housing 1010. Depending upon implementation-specific or other considerations, the housing 1010 can have a footprint less than 50 cm by 50 cm. For example, the housing 1010 can have a footprint that is less than or equal to 40 cm by 40 cm.

In a specific implementation, the single band dual concurrent network device includes low noise amplifiers (hereinafter referred to as "LNAs") coupled to the antennas. Gain of the LNAs can be adjusted in order to increase the dynamic range of the first radio module 1002 and the second radio module 1004. In increasing the dynamic range of the first radio module 1002 and the second radio module 1004, the first radio module 1002 and the second radio module 1004 are capable of receiving signals at larger strengths and weaker strengths resulting from interference caused by concurrent operation of the first radio module 1002 and the second module within the same frequency band. Depending upon implementation-specific or other considerations, gain of the LNAs can be adjusted using either or both a bypass circuit or post LNA attenuation. For example signals amplified by the LNA can be attenuated in order for the radio modules to process signals with larger strength caused through mutual interference.

In an example of operation of the example single band dual concurrent network device shown in FIG. 10, the first radio module 1002 operates in the 2.4 GHz frequency band while the second radio module 1004 operates, simultaneously with the first radio module 1002, in the 5 GHz frequency band. In the example of operation of the example network device shown in FIG. 10, the first radio module 1002 switches to operation in the 5 GHz frequency band while the second radio module 1004 continues to operate, simultaneously with the first radio module 1002, in the same 5 GHz frequency band. Further, in the example of operation of the example network device shown in FIG. 10, at least 40 dB of antenna isolation is maintained between the first radio module 1002 and the second radio module 1004.

Figure 11:
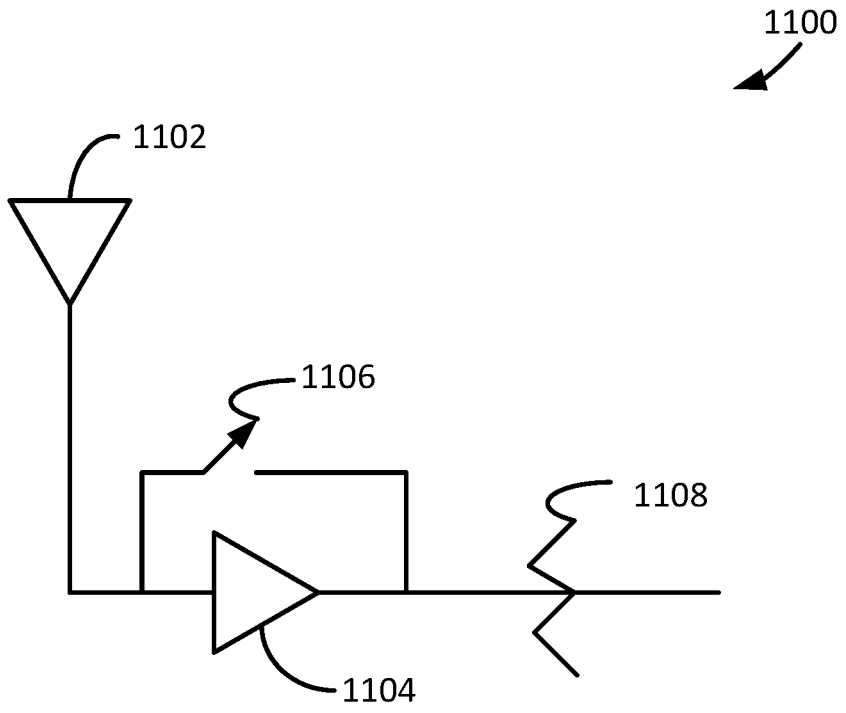
FIG. 11 is a diagram of an example antenna system including an antenna coupled to a low noise amplifier with low noise amplifier gain control to increase a dynamic range of a radio module coupled to the antenna.

FIG. 11 is a diagram 1100 of an example antenna system including an antenna coupled to a LNA with LNA gain control to increase a dynamic range of a radio module coupled to the antenna. The example antenna system can be integrated as part of the single band dual concurrent network devices described in this paper. The example antenna system shown in FIG. 10 can be used to increase the dynamic range of a radio module therefore allowing for the radio module to handle a larger number of signals distorted through interference.

The example antenna system shown in FIG. 10 includes an antenna 1102 coupled to a LNA 1104. The antenna 1102 can be a polarized antenna according to the antennas shown in FIGS. 1-9. Depending upon implementation-specific or other considerations, the antenna 1102 can be horizontally polarized or vertically polarized for use in a single band dual concurrent network device.

The example antenna system shown in FIG. 10 includes a bypass circuit 1106. The bypass circuit is intended to represent a component for providing a bypass to the LNA 1104 using an applicable technology. The bypass circuit 1106 functions to change the gain of the LNA 1104, thereby increasing a dynamic range of a radio module using the example antenna system.

The example antenna system shown in FIG. 10 includes an attenuator 1108. The attenuator 1108 can include any applicable means for attenuating a signal from the LNA 1104. In attenuating a signal from the LNA 1104, the attenuator 1108 changes the gain of the LNA, thereby increasing a dynamic range of a radio module using the example antenna system.

These and other examples provided in this paper are intended to illustrate but not necessarily to limit the described implementation. As used herein, the term "implementation" means an implementation that serves to illustrate by way of example but not limitation. The techniques described in the preceding text and figures can be mixed and matched as circumstances demand to produce alternative implementations.

We claim:

1. A polarized antenna, comprising:

a first conductive plate comprising a first plurality of antenna blades coupled to each other at a first central portion of the first conductive plate; and a second conductive plate comprising a second plurality of antenna blades coupled to each other at a second central portion of the second conductive plate, wherein the first conductive plate and the second conductive plate overlay each other and are electrically coupled together at a central joint, and wherein the first conductive plate is configured to be orthogonally polarized with respect to the second conductive plate to provide isolation between the first and second conductive plates for concurrent access to network services, via the first and second conductive plates, over a single frequency band.

2. The polarized antenna of claim 1, wherein the first plurality of antenna blades are rotationally symmetrical around the central joint.

3. The polarized antenna of claim 1, wherein the second plurality of antenna blades are rotationally symmetrical around the central joint.

4. The polarized antenna of claim 1, wherein the first plurality of antenna blades comprise three or more antenna blades, and the second plurality of antenna blades comprise three or more antenna blades.

5. The polarized antenna of claim 1, wherein at least one of the first plurality of antenna blades has a first arm radially extending from the first central portion of the first conductive plate and a first wing connected to and circumferentially extending from the first arm in a first circumferential direction and at least one of the second plurality of antenna blades has a second arm radially extending from the second central portion of the second conductive plate and a second wing connected to and circumferentially extending from the second arm in a second circumferential direction opposite to the first circumferential direction.

6. The polarized antenna of claim 1, wherein each of the first plurality of antenna blades has a first arm radially extending from the first central portion of the first conductive plate and a first wing connected to and circumferentially extending from the first arm in a first circumferential direction, each of the second plurality of antenna blades has a second arm radially extending from the second central portion of the second conductive plate and a second wing connected to and circumferentially extending from the second arm in a second circumferential direction opposite to the first circumferential direction, and a gap is formed in a circumferential direction between an extending end of each of the first wings and an extending end of each of the second wings adjacently facing the first wing.

7. The polarized antenna of claim 1, wherein each of the first plurality of antenna blades has a first arm radially extending from the first central portion of the first conductive plate and a first wing connected to and circumferentially extending from the first arm in a first circumferential direction, a length of the first wing in the first circumferential direction being shorter than a length of the first arm in radial directions, and each of the second plurality of antenna blades has a second arm radially extending from the second central portion of the second conductive plate and a second wing connected to and circumferentially extending from the second arm in a second circumferential direction opposite to the first circumferential direction, a length of the second wing in the second circumferential direction being shorter than a length of the second arm in radial directions.

8. The polarized antenna of claim 1, wherein each of the first plurality of antenna blades has a first arm radially extending from the first central portion of the first conductive plate, each of the second plurality of antenna blades has a second arm radially extending from the second central portion of the second conductive plate, and at least one of the first arms and at least one of the second arms overlay each other.

9. The polarized antenna of claim 1, wherein the first and second conductive plates and the central joint comprise electrically conductive material.

10. The polarized antenna of claim 1, wherein the first and second conductive plates are shaped to transmit or receive radio signals in the single frequency band, wherein the single frequency band is a 5 GHz frequency band.

11. The polarized antenna of claim 1, wherein the first and second conductive plates are shaped to transmit or receive radio signals in the single frequency band, wherein the single frequency band is a 2.4 GHz frequency band.

12. A device, comprising:

a polarized antenna; and a radio module configured to transmit or receive radio signals through the polarized antenna, over one or more frequency bands, wherein the polarized antenna comprises:

a first conductive plate comprising a first plurality of antenna blades coupled to each other at a first central portion of the first conductive plate, and a second conductive plate comprising a second plurality of antenna blades coupled to each other at a second central portion of the second conductive plate, wherein the first conductive plate and the second conductive plate overlay each other and are electrically coupled together at a central joint, and wherein the first conductive plate is orthogonally polarized with respect to the second conductive plate to provide isolation between the first and second conductive plates for concurrent access to network services, via the first and second conductive plates.

13. The device of claim 12, wherein the radio module is configured to be wirelessly coupled through a Wi-Fi connection to the device acting as a station in accessing the network services over the Wi-Fi connection.

14. The device of claim 12, wherein the radio module is configured to transmit or receive the radio signals in compliance with the IEEE 802.11 standard.

15. The device of claim 12, wherein the radio module is adjustable to transmit or receive signals in 2.4 GHz and 5 GHz frequency bands.

16. The device of claim 12, wherein at least one of the first plurality of antenna blades has a first arm radially extending from the first central portion of the first conductive plate and a first wing connected to and circumferentially extending from the first arm in a first circumferential direction, and at least one of the second plurality of antenna blades has a second arm radially extending from the second central portion of the second conductive plate and a second wing connected to and circumferentially extending from the second arm in a second circumferential direction opposite to the first circumferential direction.

17. The device of claim 12, wherein each of the first plurality of antenna blades has a first arm radially extending from the first central portion of the first conductive plate and a first wing connected to and circumferentially extending from the first arm in a first circumferential direction, each of the second plurality of antenna blades has a second arm radially extending from the second central portion of the second conductive plate and a second wing connected to and circumferentially extending from the second arm in a second circumferential direction opposite to the first circumferential direction, and a gap is formed in a circumferential direction between an extending end of each of the first wings and an extending end of each of the second wings adjacently facing the first wing.

18. The device of claim 12, wherein each of the first plurality of antenna blades has a first arm radially extending from the first central portion of the first conductive plate and a first wing connected to and circumferentially extending from the first arm in a first circumferential direction, a length of the first wing in the first circumferential direction being shorter than a length of the first arm in radial directions, and each of the second plurality of antenna blades has a second al radially extending from the second central portion of the second conductive plate and a second wing connected to and circumferentially extending from the second arm in a second circumferential direction opposite to the first circumferential direction, a length of the second wing in the second circumferential direction being shorter than a length of the second arm in radial directions.

19. The device of claim 12, wherein each of the first plurality of antenna blades has a first arm radially extending from the first central portion of the first conductive plate, each of the second plurality of antenna blades has a second arm radially extending from the second central portion of the second conductive plate, and at least one of the first arms and at least one of the second arms overlay each other.

20. The device of claim 12, wherein the first and second conductive plates and the central joint comprise electrically conductive material.

* * * * *